US007353573B2

(12) United States Patent
Anscher

(10) Patent No.: US 7,353,573 B2
(45) Date of Patent: Apr. 8, 2008

(54) BUCKLE WITH PIVOTING AND SLIDING STRAP SECURING BAR

(76) Inventor: Joseph Anscher, 1928 Midlane, Muttontown, NY (US) 11791

( * ) Notice: Subject to any disclaimer, the term of this patent is extended or adjusted under 35 U.S.C. 154(b) by 0 days.

(21) Appl. No.: 11/593,790

(22) Filed: Nov. 7, 2006

(65) Prior Publication Data

US 2007/0050954 A1 Mar. 8, 2007

Related U.S. Application Data

(63) Continuation-in-part of application No. 11/098,057, filed on Apr. 4, 2005, now abandoned.

(51) Int. Cl.
*A44B 11/25* (2006.01)

(52) U.S. Cl. ..... 24/625; 24/170; 24/180

(58) Field of Classification Search ..... 24/614–616, 24/625, 170, 171, 193, 196, 180
See application file for complete search history.

(56) References Cited

U.S. PATENT DOCUMENTS 3,888,541 A 6/1975 Stephenson
4,389,756 A 6/1983 Kasama
5,123,153 A 6/1992 Krauss
5,774,947 A 7/1998 Anscher
D401,533 S 11/1998 Anscher
6,148,486 A * 11/2000 Uehara et al. ..... 24/170
6,647,750 B2 11/2003 Kaneko et al.

* cited by examiner

*Primary Examiner*—James R Brittain
(74) *Attorney, Agent, or Firm*—Collard & Roe, P.C.

(57) ABSTRACT

A buckle having a male portion and a female portion. The male portion has two sidewalls, first and second retaining bars and at least one locking arm. There is a slidable and pivotable strap gripping bar disposed adjacent the first strap retaining bar. The strap gripping bar is adapted to slide between a release position and a gripping position. The female portion comprises a hollow body with an open end and at least one locking slot for receiving the locking arm. When the male portion is inserted into the female portion, the locking arm locks into the locking slot and the female portion pushes the strap gripping bar into a gripping position, which grips a strap threaded through the retaining bars, and prevents the strap from slipping. When the male portion is released from the female portion, the strap gripping bar slides into the release position and allows adjustment of the strap.

12 Claims, 7 Drawing Sheets

BUCKLE WITH PIVOTING AND SLIDING STRAP SECURING BAR

CROSS REFERENCE TO RELATED APPLICATIONS

This application is a continuation-in-part of U.S. patent application Ser. No. 11/098,057, filed on Apr. 4, 2005 now abandoned.

BACKGROUND OF THE INVENTION

1. Field of the Invention

The invention relates to a buckle for use in belts, seat belts, backpacks, or other uses. In particular, the invention relates to a buckle with a slidable bar that secures the buckle to a strap to prevent inadvertent slippage of the strap during use.

2. The Prior Art

In conventional plastic buckles that are used in belt applications, i.e., to secure two straps together, each side of the buckle typically has a bar around which each strap is threaded to attach the strap to the buckle piece. An example of such a buckle is shown in United States Design Patent No. D401,533, the disclosure of which is herein incorporated by reference.

One problem encountered with these basic buckles is that the straps often slip out of their initially tensioned state, and cause the belt to loosen unexpectedly. Another problem is that it can often be difficult to loosen the belt when desired, because the straps can sometimes be stuck on the bars, especially if the strap retaining bars are spaced close to the buckle body.

One solution to this problem is described in U.S. Pat. No. 5,774,947 for an Anti-Slip Webbing Adjustor. This patent uses a pivoting bar disposed adjacent the strap-retaining bar. When the strap is threaded around the strap retaining bar, the pivoting bar rests against the strap and prevents backward sliding movement of the strap to prevent loosening. The pivoting bar is spring loaded to press against the strap in a resting position. The strap retaining bar and the pivoting bar can be grooved or have teeth to increase the amount of grip on the strap. To release the strap, the user pivots the bar away from the strap to allow the strap to slide freely. While this is an effective way to prevent slippage, it requires extra work on the part of the user to loosen the belt. Additionally, pivoting the bar may require more dexterity than the user possesses, especially in low light or when the buckle is in motion.

SUMMARY OF THE INVENTION

It is therefore an object of the invention to provide a buckle that prevents inadvertent slippage of the strap, yet allows the user to easily loosen the strap when desired.

It is another object of the invention to provide such a buckle that is simple to construct and operate.

These and other objects are accomplished by a buckle having a male portion and a female portion. The male portion comprises two sidewalls, first and second retaining bars disposed between the sidewalls and at least one locking arm. There is a slidable strap gripping bar disposed between the two side walls and adjacent the first strap retaining bar. The strap gripping bar is adapted to slide between a release position and a gripping position. For ease of threading a strap, the first strap retaining bar may be offset vertically from the second strap retaining bar.

The female portion comprises a hollow body with an open end and at least one locking slot for receiving the at least one locking arm. When the male portion is inserted into the female portion, the locking arm locks into the locking slot and the female portion pushes the strap gripping bar into a gripping position. When a strap is threaded through the strap retaining bars and the strap gripping bar is in the gripping position, the strap gripping bar grips the strap and prevents the strap from slipping. When the male portion is released from the female portion, the strap gripping bar slides into the release position and allows adjustment of the strap. The strap gripping bar can also be released from pressing against the strap retaining bar while the buckle is locked, by placing two fingers against the ends of the strap gripping bar that extend through the sides of the buckle, and rotating the strap gripping bar with one's fingers so that the bar is no longer touching the strap retaining bar. This allows the strap to be adjusted without unlocking the buckle. When the proper adjustment is reached, the strap gripping bar is released, and it resumes its gripping position against the strap.

The strap gripping bar may have teeth along a side facing the strap retaining bar, so that when the strap gripping bar is in a gripping position, the teeth grip the strap.

The strap gripping bar may comprise a pushing surface facing away from the strap retaining bars, which abuts the female portion when the male and female portion are locked together and allows the female portion to push the strap gripping bar into the gripping position.

In one embodiment, the strap gripping bar has two ends and has at least one protrusion at each end. There is at least one aperture in each of said sidewalls of the female portion. The at least one protrusion extends through the at least one aperture to connect the strap gripping bar to the male portion.

In a preferred embodiment, there are two protrusions on each end of the strap gripping bar, and two apertures in each of the sidewalls. In motion, the strap gripping bar slides and pivots between the release position and the gripping position.

In a preferred embodiment, there are two locking arms and two locking slots.

The female portion may also have least one strap retaining bar.

In another embodiment, the strap gripping bar is initially integrally molded with the male portion via locking gates. Pushing the male portion into the female portion and locking the male portion to the female portion causes the female portion to push against the slidable strap gripping bar and break the molding gates on the male portion to separate the strap gripping bar from the male portion.

In another version of this embodiment, the locking gates are formed such that they can actually be sheared or broken as the parts are ejected from the mold during the molding process, thereby not making it necessary to have these two connection points broken as the male is inserted in to the female. After ejection from the mold, the gripping bar floats freely. In this embodiment, the molding gates are submerged under the steel of the mold so as the part ejects, it breaks the gate.

In another embodiment, the strap gripping bar has a series of protrusions along its side facing the strap retaining bar, and the strap retaining bar has a series of corresponding indentations facing the protrusions. When the strap gripping bar is pushed toward the strap retaining bar, the protrusions nest in the indentations. For use with this buckle, a strap is provided that has a series of corresponding holes therethrough. When the strap is threaded through the buckle, the protrusions in the strap gripping bar extend through the holes in the strap to securely retain the strap in a fixed position. No slippage of the strap can occur until the strap gripping bar is slid backward upon release of the male portion to release the strap. Preferably, there are at least 3 protrusions, 3 indentations and 3 holes, with several rows of the 3 holes along the strap, but any other suitable arrangement is also possible.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
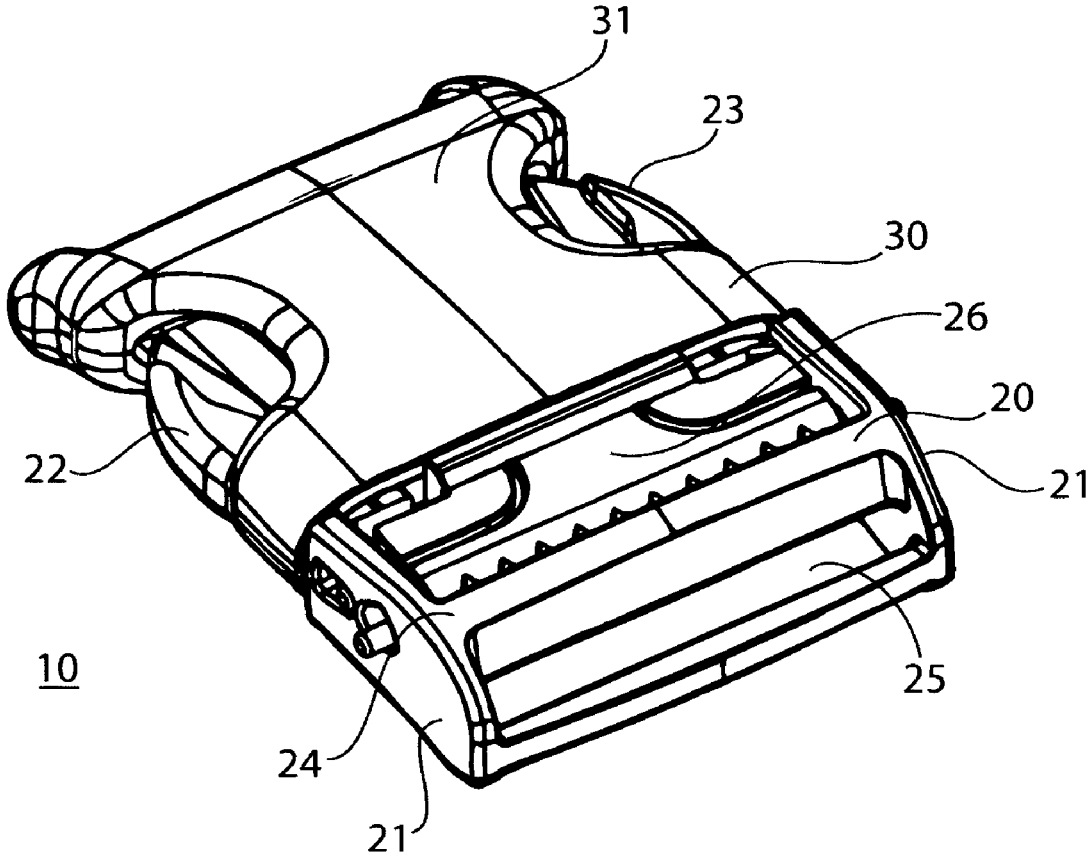
FIG. 1 shows a perspective view of one embodiment of the buckle according to the invention.
Figure 2:
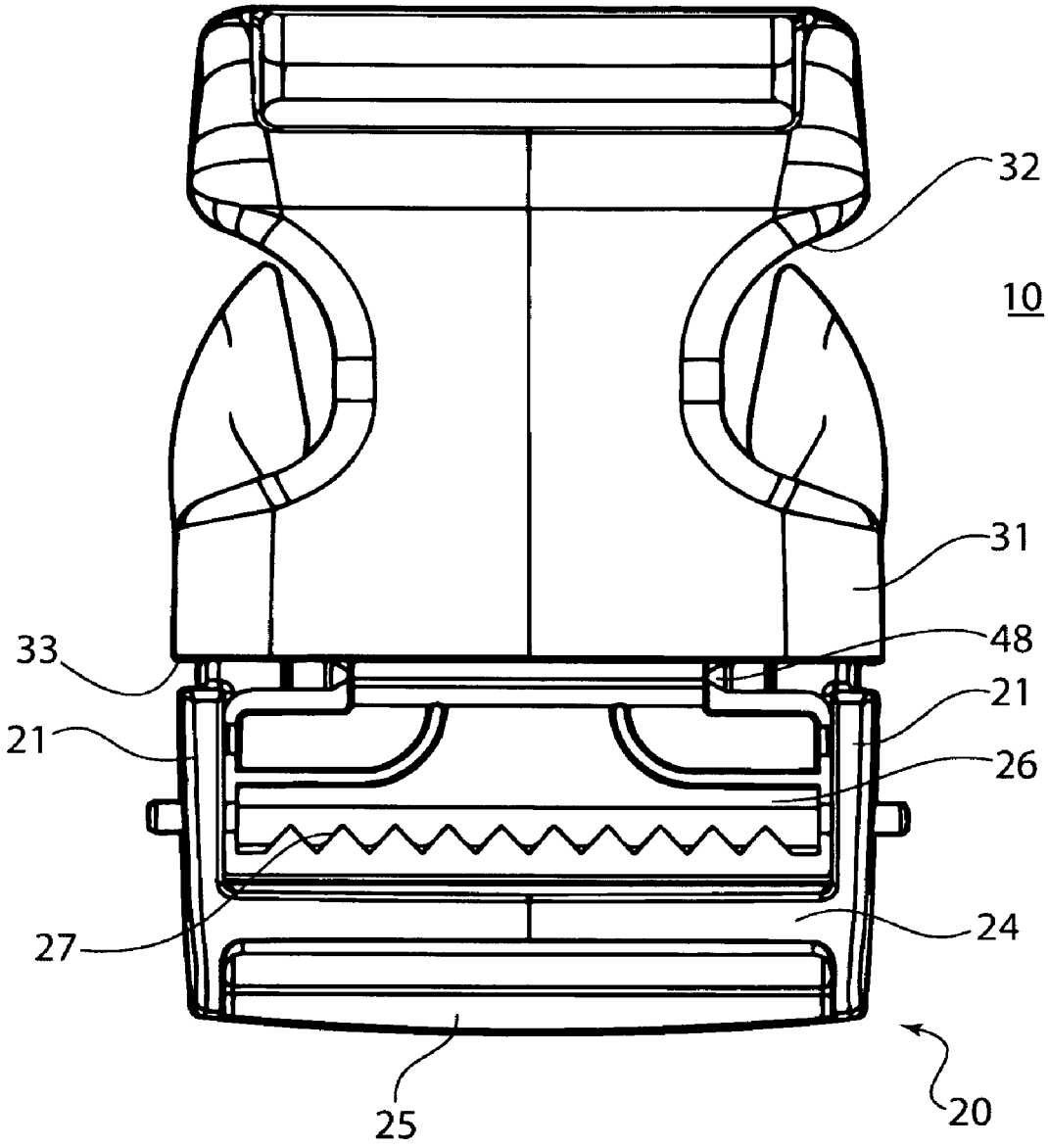
FIG. 2 shows a top view of the buckle of FIG. 1.
Figure 3:
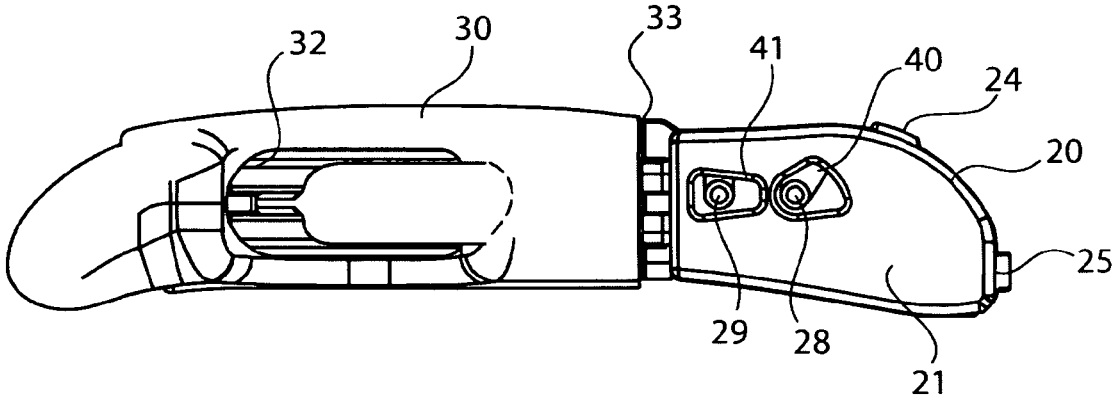
FIG. 3 shows a side view of the buckle of FIG. 1.

Referring now in detail to the drawings, FIGS. 1-3 show buckle 10 in a locked position. Buckle 10 comprises a male portion 20 and a female portion 30. Male portion 20 has two sidewalls 21, two locking arms 22, 23, a first strap retaining bar 24 and a second strap retaining bar 25. A slidable or pivotable strap gripping bar 26 is disposed adjacent first strap retaining bar 24.

Figure 4:
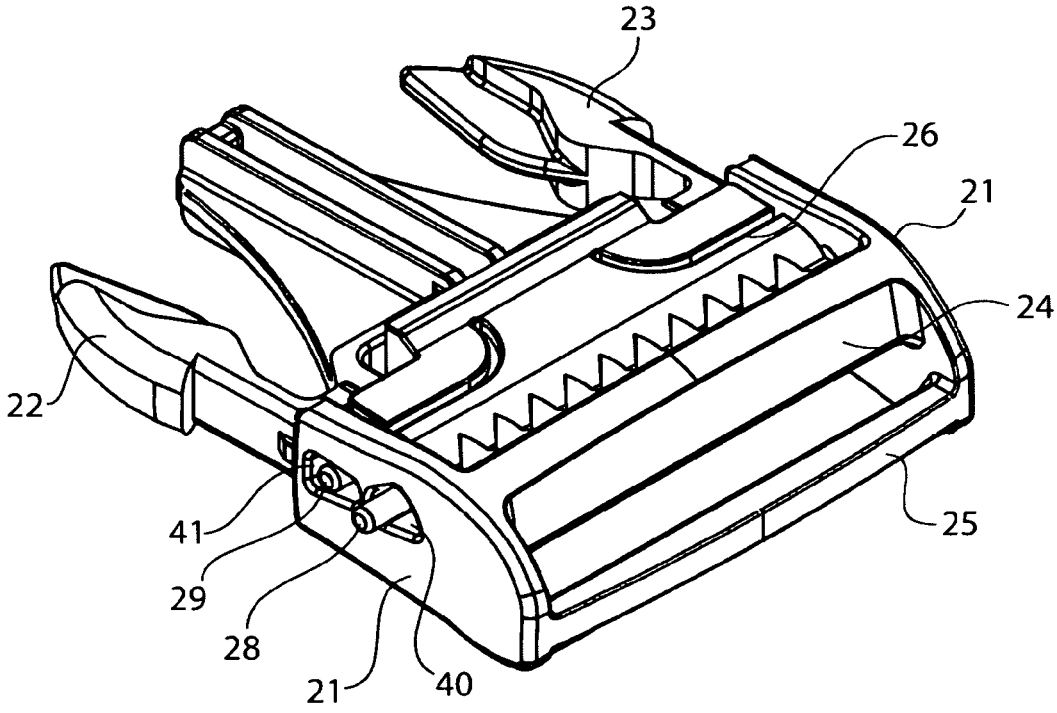
FIG. 4 shows a perspective view of the male portion of FIG. 1.
Figure 5:
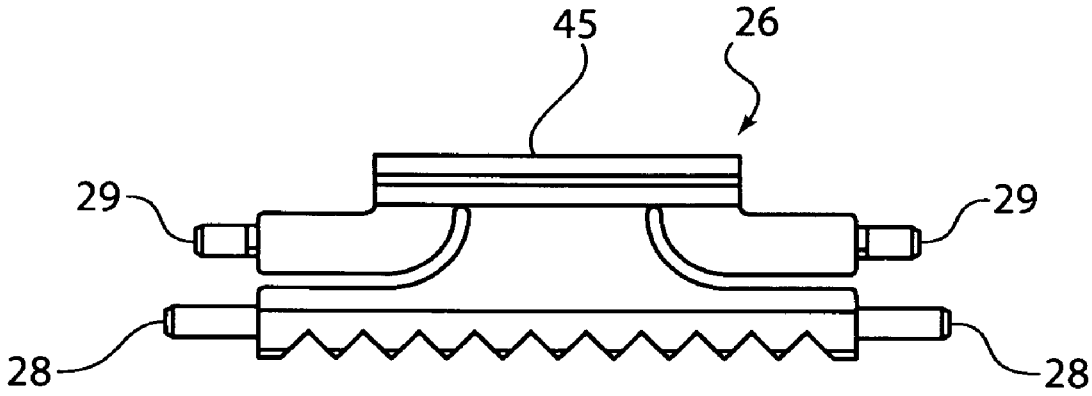
FIG. 5 shows a top view of the strap gripping bar.

Strap gripping bar 26 has a plurality of teeth 27 disposed along a face adjacent strap retaining bar 24. Strap gripping bar 26 is connected to male portion 20 via two protrusions 28, 29 on each end of strap gripping bar 26, which extend through two apertures 40,41 on each of sidewalls 21 of male portion 20. The shape of the protrusions 28, 29 and of apertures 40, 41 are such that strap gripping bar 26 can slide and/or pivot between a gripping position and a release position, which will be described in detail below. A detailed picture of male portion 20 is shown in FIG. 4, and a detailed picture of strap gripping bar 26 is shown in FIG. 5.

Figure 6A:
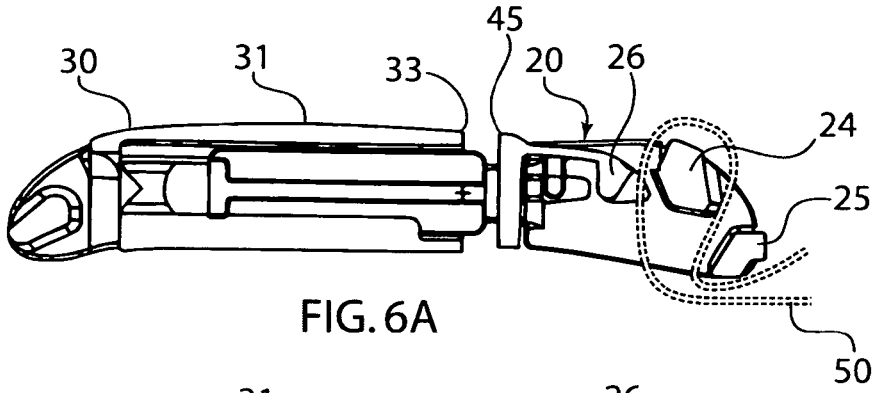
FIGS. 6A-6E show a side view of the buckle in different stages as the male portion is inserted and locked into the female portion.
Figure 6B:
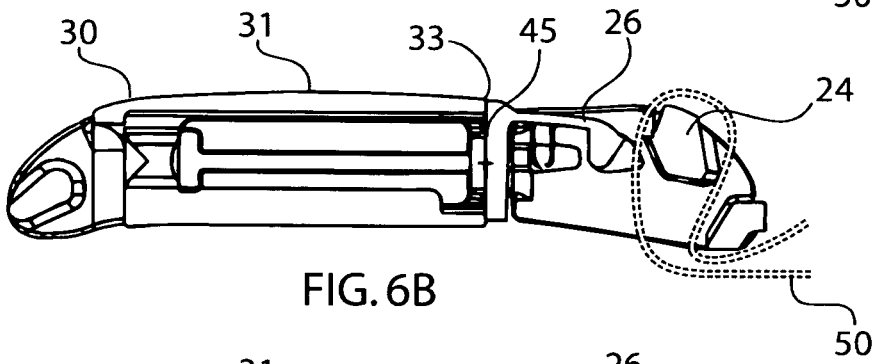
Figure 6C:
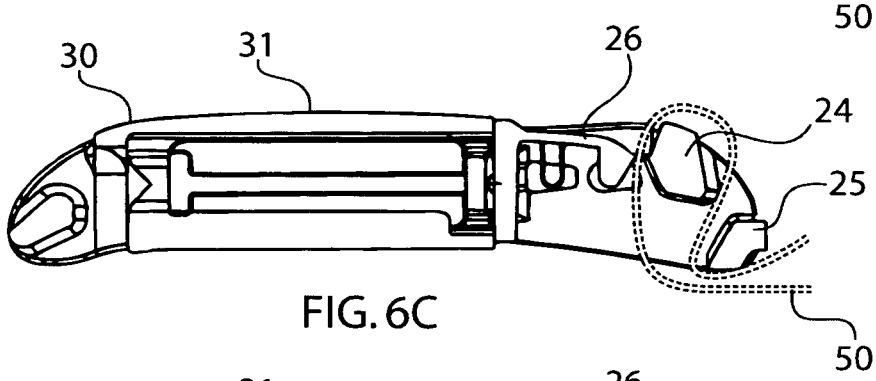
Figure 6D:
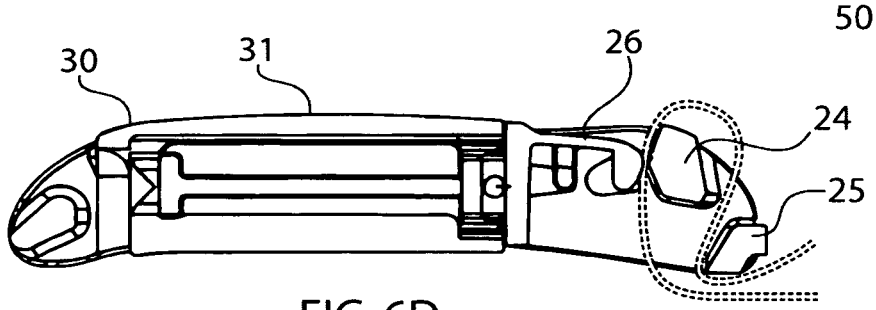
Figure 6E:
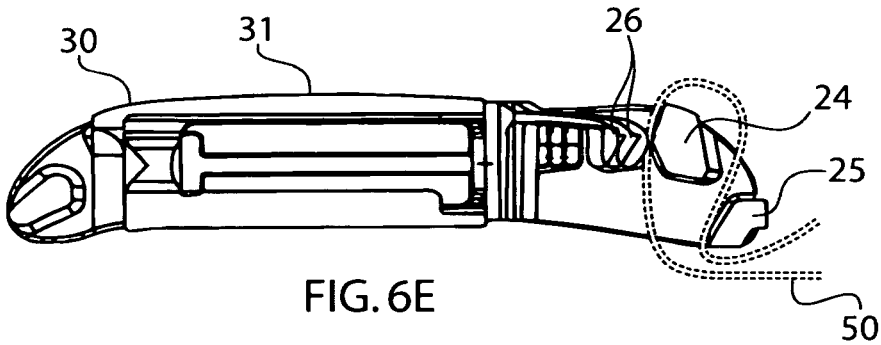

As shown in FIGS. 1-3, female portion 30 has a hollow body 31, two locking slots 32, and a top edge 33. Inserting male portion 20 into female portion 30 causes top edge 33 of female portion 30 to press against platform 45 of strap gripping bar 26, and move strap gripping bar 26 from a release position into a gripping position, where it presses a strap 50 against strap retaining bar 27. This movement is shown sequentially in FIGS. 6A-6E. FIG. 6A shows the buckle in a released state, and FIGS. 6B-6D show the buckle progressively becoming locked. FIG. 6E shows the release of the buckle back to an unlocked state. Upon release of male portion 20 from female portion 30, strap gripping bar 26 moves back into a release position, because front edge 33 of female portion 30 is not pressing against platform 45 anymore.

Strap gripping bar 26 can also be released from pressing against strap retaining bar 27 while the buckle is locked, by placing two fingers against ends 28 and rotating strap gripping bar 26 upward with one's fingers so that strap gripping bar 26 is no longer touching strap retaining bar 27. This allows strap 50 to be adjusted without unlocking buckle 10. When the proper adjustment is reached, the user releases ends 28 so that strap gripping bar 26 falls back into a gripping position against strap retaining bar 27. The larger aperture 40 for ends 28 allows for the pivoting action.

In preferred embodiment, as shown in FIG. 2, male portion 20 is molded as a single piece with strap gripping bar 26, through molding gates 48. Upon initial insertion of male portion 20 into female portion 30, the pressure of front edge 33 against platform 45 causes molding gates 48 to break and separate strap gripping bar 26 from the rest of male portion 20.

Figure 7:
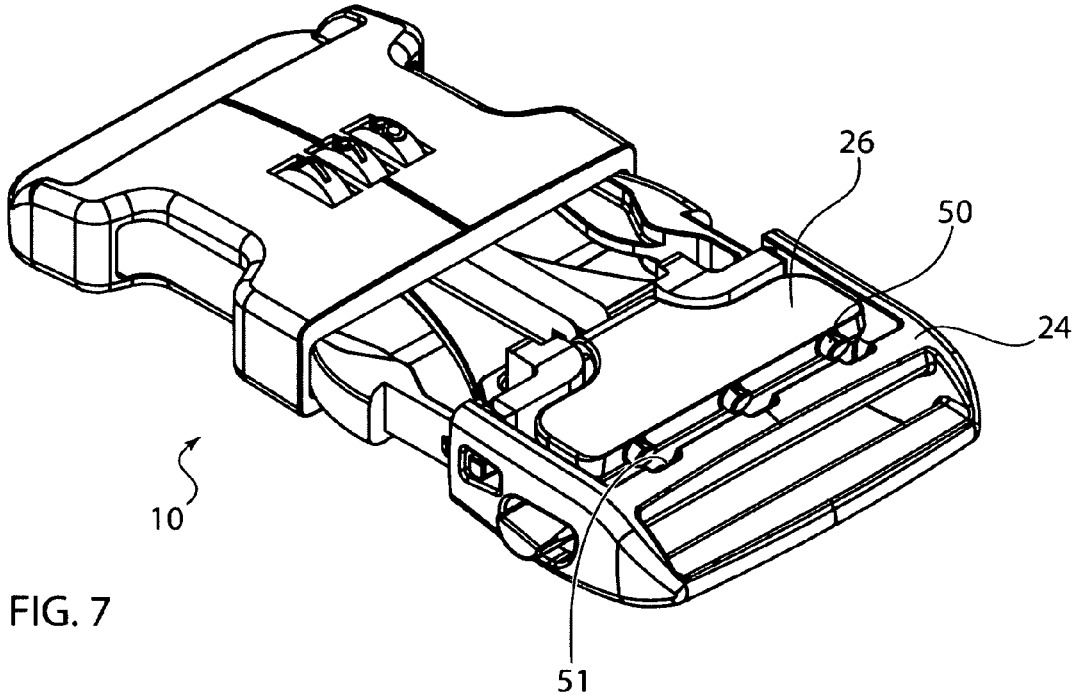
FIG. 7 shows an alternative version of the buckle according to the invention.
Figure 8:
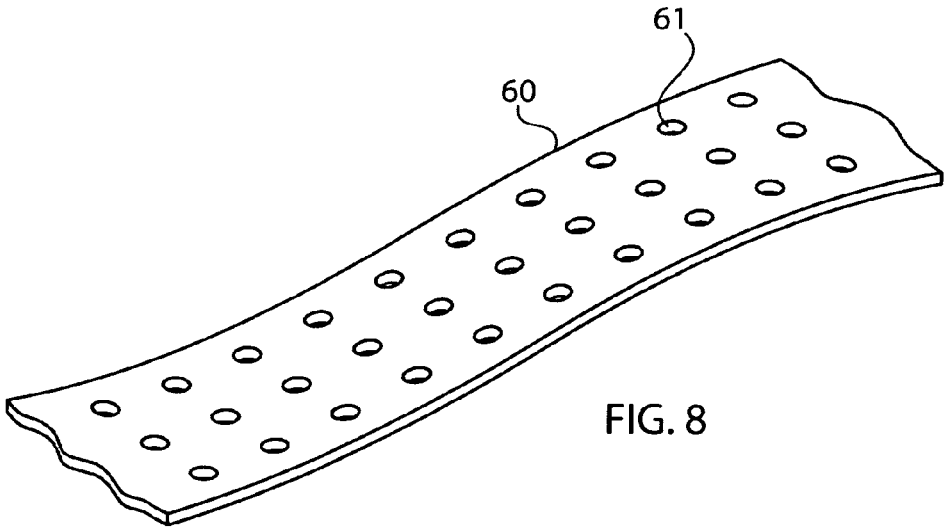
FIG. 8 shows a strap for use with the buckle according to FIG. 7.
Figure 9:
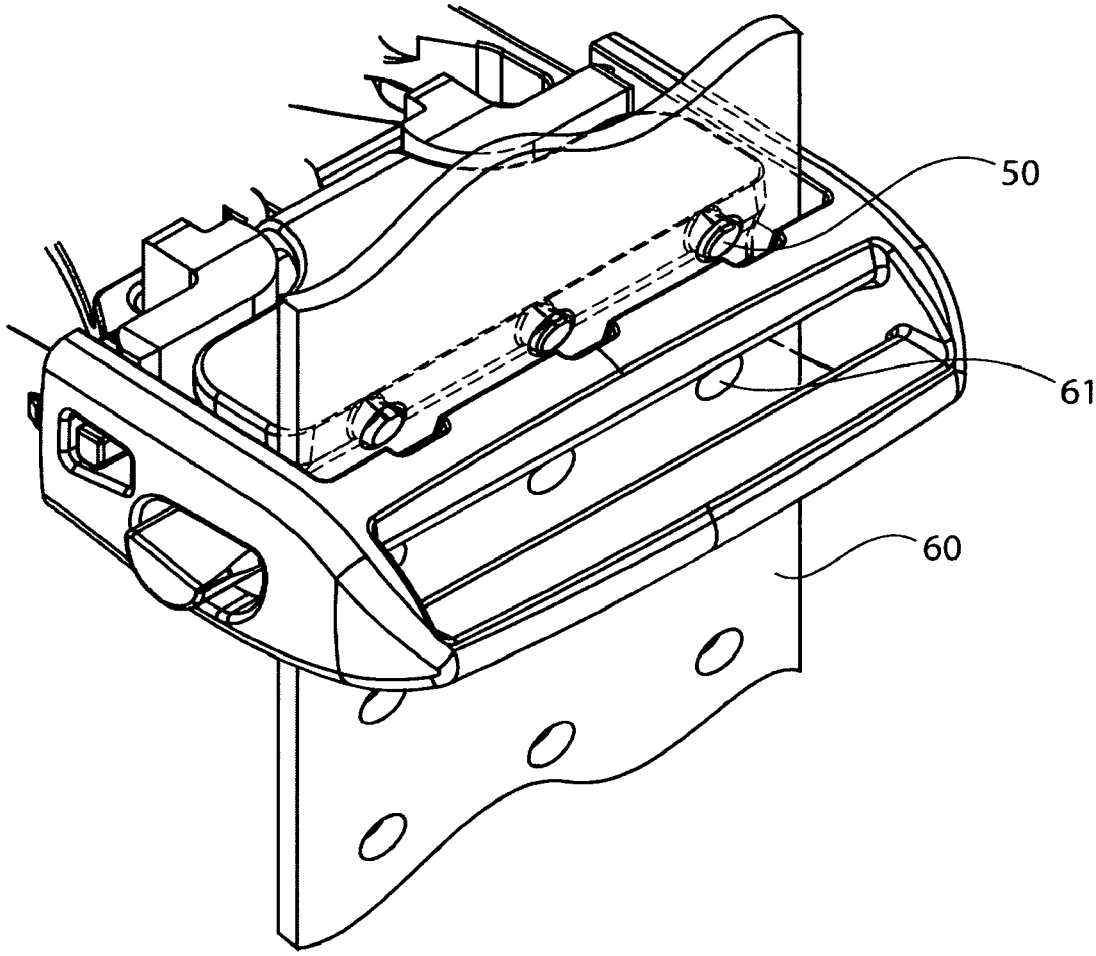
FIG. 9 shows an end view of the buckle according to FIG. 7 with the strap according to FIG. 8 inserted therethrough.

FIGS. 7-9 show an alternative embodiment of the buckle 10 according to the invention. In this embodiment, strap gripping bar 26 has a series of protrusions 50 located along its side facing strap retaining bar 24. Strap retaining bar 24 also has a series of corresponding indentations 51, so that pushing strap gripping bar 26 into strap retaining bar 24 causes protrusions 50 to nest inside indentations 51.

FIG. 8 shows a strap 60 for use with the buckle 10 shown in FIG. 7. Strap 60 has a series of holes 61 disposed in a pattern that corresponds with the pattern of protrusions 50 and indentations 51, so that when strap 60 is threaded through buckle 10, as shown in FIG. 9, protrusions 50 extend through holes 61 and nest in indentations 51, and prevent any slippage of strap 60. Releasing male portion 20 from female portion 30 also releases strap gripping bar 26 and allows strap 60 to be adjusted. Strap 60 can have a hole pattern repeatedly along its length, so that it can be placed in buckle 10 along various parts of its length. Although 3 protrusions/holes/indentations are shown here, other patterns could also be used, with fewer or more protrusions, holes and indentations.

Accordingly, while only a few embodiments of the present invention have been shown and described, it is obvious that many changes and modifications may be made thereunto without departing from the spirit and scope of the invention.

What is claimed is:

1. A buckle, comprising:

a male portion comprising:

two sidewalls, first and second retaining bars disposed between said sidewalls;

at least one locking arm; and a slidable and pivotable strap gripping bar disposed between said two side walls and adjacent said first strap retaining bar, said strap gripping bar adapted to slide between a release position and a gripping position, and also pivot between a release position and gripping position; and a female portion comprising:

a hollow body with an open end; and at least one locking slot for receiving said at least one locking arm;

wherein when said male portion is inserted into said female portion, said locking arm locks into said locking slot and said female portion pushes said strap gripping bar into a gripping position, wherein if a strap is threaded through said strap retaining bars and said strap gripping bar is in said gripping position, said strap gripping bar grips said strap and prevents said strap from slipping, wherein said strap can be adjusted by pivoting said strap gripping bar out of said gripping position until a desired adjustment of said strap is reached, at which point said strap gripping bar can be released back into said gripping position, wherein when said male portion is released from said female portion, said strap gripping bar slides into the release position and allows adjustment of said strap, and wherein said strap gripping bar has two ends and two protrusions at each end, and wherein there are two apertures in each of said sidewalls, a first one of said protrusions on each end of the strap gripping bar extending through a first one of said apertures on each of the sidewalls to connect said strap gripping bar to said male portion, and a second one of said protrusions on each end of the strap gripping bar extending through a second one of said apertures on each of the sidewalls so that the second protrusions can be raised and lowered to pivot the strap gripping bar to adjust the strap.

2. The buckle according to claim 1, wherein said strap gripping bar has teeth along a side facing said strap retaining bar, so that when said strap gripping bar is in a gripping position, said teeth grip the strap.

3. The buckle according to claim 1, wherein said strap gripping bar comprises a pushing surface facing away from said strap retaining bars, said pushing surface abutting said female portion when said male and female portion are locked together and allowing the female portion to push the strap gripping bar into the gripping position.

4. The buckle according to claim 1, wherein there are two locking arms and two locking slots.

5. The buckle according to claim 1, further comprising at least one strap retaining bar disposed on said female portion.

6. The buckle according to claim 1, wherein said first strap retaining bar is offset vertically from said second strap retaining bar.

7. The buckle according to claim 1, wherein said strap gripping bar is initially integrally molded with said male portion via locking gates.

8. The buckle according to claim 1, wherein said strap gripping bar is equipped with at least one protrusion along a side facing the first strap retaining bar.

9. The buckle according to claim 8, wherein said first strap retaining bar is equipped with at least one indentation corresponding to the at least one protrusion on the strap gripping bar, so that when said strap gripping bar is pushed against said first strap retaining bar, said at least one protrusion rests in said at least one indentation.

10. The buckle according to claim 8, further comprising a strap threaded through the buckle such that a portion of the strap extends between the strap gripping bar and the first strap retaining bar, and wherein said strap has at least one hole corresponding to the at least one protrusion on the strap gripping bar, and wherein said at least one protrusion extends through the at least one hole in the strap and prevent slippage of the strap.

11. The buckle according to claim 1, wherein the strap gripping bar can be pivoted by placing two fingers against ends of the strap gripping bar and rotating the strap gripping bar out of the gripping position.

12. A buckle, comprising:

a male portion comprising:

two sidewalls, first and second retaining bars disposed between said sidewalls;

at least one locking arm; and a slidable and pivotable strap gripping bar disposed between said two side walls and adjacent said first strap retaining bar, said strap gripping bar adapted to slide between a release position and a gripping position, and also pivot between a release position and gripping position, said strap gripping bar being equipped with at least one protrusion along a side facing the first strap retaining bar;

a female portion comprising:

a hollow body with an open end; and at least one locking slot for receiving said at least one locking arm; and a strap threaded through the buckle such that a portion of the strap extends between the strap gripping bar and the first strap retaining bar, said strap having at least one hole corresponding to the at least one protrusion on the strap gripping bar, and said at least one protrusion extending through the at least one hole in the strap and prevent slippage of the strap, wherein when said male portion is inserted into said female portion, said locking arm locks into said locking slot and said female portion pushes said strap gripping bar into a gripping position, wherein said strap can be adjusted by pivoting said strap gripping bar out of said gripping position until a desired adjustment of said strap is reached, at which point said strap gripping bar can be released back into said gripping position; and wherein when said male portion is released from said female portion, said strap gripping bar slides into the release position and allows adjustment of said strap.

* * * * *